United States Patent [19]

van Diepenbroek et al.

[11] 4,098,591

[45] Jul. 4, 1978

[54] APPARATUS AND METHOD FOR REMOVING NON-CONDUCTIVE PARTICLES FROM A GAS STREAM

[75] Inventors: Alfred Erich Wibrandt van Diepenbroek, Ermelo; Jan Hendrik Wormgoor, Amersfoort; Cornelis Schilperoort, Ermelo, all of Netherlands

[73] Assignee: Bronswerk Heat Transfer B.V., Nijkerk, Netherlands

[21] Appl. No.: 792,303

[22] Filed: Apr. 29, 1977

Related U.S. Application Data

[63] Continuation-in-part of Ser. No. 575,395, May 7, 1975, abandoned.

[51] Int. Cl.[2] ..... B03C 3/41

[52] U.S. Cl. ..... 55/2; 55/101; 55/150; 55/155

[58] Field of Search ..... 55/2, 101, 150, 151, 55/154, 155, DIG. 38; 427/121, 124

[56] References Cited

U.S. PATENT DOCUMENTS

| | | | |
|---|---|---|---|
| 913,941 | 3/1909 | Liblake | 55/151 |
| 1,650,097 | 11/1927 | Schmidt | 55/155 |
| 1,650,105 | 11/1927 | Anderson | 55/155 |
| 1,992,974 | 3/1935 | Thompson | 55/155 |
| 2,277,712 | 3/1942 | Otto | 55/150 |
| 2,571,079 | 10/1951 | Warburton | 55/155 |
| 2,579,445 | 12/1951 | Warburton | 55/155 |
| 2,616,165 | 11/1952 | Brennan | 55/155 |
| 2,879,183 | 3/1959 | Doherty et al. | 427/124 |
| 2,888,092 | 5/1959 | Powers | 55/155 |
| 2,958,393 | 11/1960 | Lueder | 55/155 |
| 3,081,215 | 3/1963 | Held et al. | 55/155 |
| 3,406,669 | 10/1968 | Edwards | 55/155 |
| 3,423,306 | 1/1969 | Horwitz et al. | 55/DIG. 38 |
| 3,487,610 | 1/1970 | Brown et al. | 55/155 |
| 3,582,694 | 6/1971 | Bourdine | 55/155 |
| 3,790,406 | 2/1974 | Sakai et al. | 427/121 |
| 3,966,435 | 6/1976 | Penney | 55/150 |

FOREIGN PATENT DOCUMENTS

| | | | |
|---|---|---|---|
| 600,967 | 7/1960 | Canada | 55/155 |
| 845,179 | 10/1970 | Canada | 55/154 |
| 491,827 | 1/1930 | Fed. Rep. of Germany | 55/155 |
| 1,196,466 | 7/1965 | Fed. Rep. of Germany | 427/124 |
| 734,207 | 7/1955 | United Kingdom | 55/150 |

*Primary Examiner*—Frank W. Lutter
*Assistant Examiner*—David L. Lacey
*Attorney, Agent, or Firm*—Haseltine, Lake & Waters

[57] ABSTRACT

A dipole separator, wherein solid or liquid non-conductive particles are removed from a gas stream by an electric D.C. field generated between two co-axial cylindrical electrodes and having a relatively low intensity so that substantially no ionization occurs in the gas stream. In order to increase the separating efficiency, one of the electrodes, preferably the inner electrode, is provided through at least a part of its axial length with a covering consisting of a semi-conductive fibrous material having a multitude of outwardly projecting fibers, such as asbestos.

10 Claims, 2 Drawing Figures

APPARATUS AND METHOD FOR REMOVING NON-CONDUCTIVE PARTICLES FROM A GAS STREAM

CROSS-REFERENCE

This application is a continuation-part of patent application Ser. No. 575,385 filed on May 7, 1975, now abandoned.

BACKGROUND OF THE INVENTION

The invention relates to an apparatus for removing solid or liquid non-conductive particles from a gas stream wherein the gas stream is passed through a separating space bounded by two co-axial cylindrical electrodes and wherein an electric D.C. field is generated between the electrodes with such an intensity that substantially no ionization occurs in the gas stream.

An apparatus of this kind is indicated, in practice, as a dipole separator. Due to the use of a relatively low field intensity in the separating space, there is no, or substantially no ionization in the gas stream so that the separation is mainly based on the phenomenon that dipole charges are generated in the particles to be removed. In order to attain this effect, the field intensity in the separating space must be lower than a critical value which may amount to 25–50 kV/inch in the case that the gas stream consists of air.

The theory of dipole separation has been explained in an article by Dr. Günter Zebel, entitled: "Ueber die Aggregatbildung zwischen kugelförmigen Aerosolteilchen mit parallel ausgerichteten Dipolmomenten" in the German periodical "Staub", Vol. 23, Nr. 5, May 1963, pages 263–268. This article does not contain any information about the shape and the arrangement of the electrodes but it states very definitely that the force exerted on the particles to be removed is proportional to the gradient of the electric field intensity. In fact a dipole charge induced in a particle comprises a positive charge at one end and a negative charge at the other end; if the field is homogeneous in a direction perpendicular to the electrodes equal forces in opposite directions are exerted on both charges so that the particle has no inducement to move to either electrode. Thus in order to effect a separation the field must be inhomogeneous in a direction perpendicular to the electrodes.

A suitable construction for a dipole separator has been disclosed in U.S. Patent Application Ser. No. 447,775 (Van Diepenbroek et al.), filed on Mar. 6, 1974, now U.S. Pat. No. 3,970,437. In this construction the separating space is bounded by two co-axial cylinders. The inner cylinder is conductive whereas the outer cylinder is non-conductive and carries an electrode or an electrode system covering only a part of the surface of the outer cylinder, whereby the field is rendered inhomogeneous since it is locally concentrated at the outer cylinder.

The idea to use an electric field with a relatively low intensity so as to avoid any ionization has been disclosed in U.S. Pat. No. 1,992,974 in the name of Richard C. Thompson. In the apparatus described in this patent the electrodes consist of flat plates arranged in parallel whereby the field is homogeneous in a direction perpendicular to the electrodes and the above mentioned condition is not satisfied. The electrodes are all provided with a covering consisting of a non-conductive fibrous material intended to capture any conductive particles so that they are not repelled by the electrodes. Since the field is homogeneous there cannot occur a dipole separation in the normal sense of the expression. Presumably the operation is based on the capture of particles that move incidentally to the covering for instance by a turbulence in the gas stream.

U.S. Pat. No. 1,650,097 in the name of Walter A. Schmidt discloses a separator with co-axial cylindrical electrodes. However the field intensity is so large in this separator that there is a substantial ionization in the gas stream. The inner electrode is shaped as a thin rod in order to enhance the ionization. Further more the inner electrode is provided with a discontinuous covering consisting of a non-conductive material in order to provide for a uniform electric discharge.

BRIEF SUMMARY OF THE INVENTION

The known dipole separators have the disadvantage that the separating efficiency is rather low.

It is the object of the invention to improve the efficiency of a dipole separator in such a sense that a larger percentage of the particles suspended in the gas stream is removed.

For this purpose, the apparatus according to the invention is carried out in such manner, that one of the electrodes, preferably the inner electrode, is provided with a covering consisting of a semi-conductive fibrous material having a multitude of outwardly projecting thin fibers.

In many cases the effect of the invention is already obtained to a sufficient extent if the covering only extends through a portion of the length of the separating space, the said portion being situated on the inlet side of the gas stream.

The expression "semi-conductive" as used in the sense of the invention is extended to express that the fibrous material used for the covering is neither a good conductor nor an insulator. The use of a highly conductive covering would only lead to a reduction of the distance between the electrodes which has little or no influence on the efficiency. If the covering would consist of an insulating material the field would be exclusively determined by the electrodes, so that the desired effect would not be obtained either.

A covering material naturally satisfying the required conditions is asbestos. Asbestos is a fibrous material having a large number of outwardly projecting thin fibers and it is somewhat, but not too strongly conductive. It is preferred to use a ribbon woven from asbestos fibers, which is wound on the inner electrode.

Another coating material that may be successfully used is a glass fabric of which the fibers have been rendered slightly conductive by a surface treatment with a conductive liquid. of a synthetic material; the metallic fibers are preferably made of stainless steel. A material of this kind is commercially available under the trade mark "Needlona".

Finally, good results may also be obtained with a covering consisting of a textile fabric of which the fibers have been provided with a conductive layer by vacuum deposition.

Although the effect of the covering cannot be conclusively explained, it may be presumed that a local impact ionization occurs at the beginning of the operation of the apparatus due to the activity of the fine outwardly directed fibers, and that this impact ionization leads to a weak local spray discharge. When the operation of the apparatus is observed by means of a window, it may be seen that a dust layer is formed on the fibers at the beginning of the separation. It may be presumed that this dust layer forms a good base for the attachment of further dust particles, and that the increased efficiency is due to this improved attachment.

With respect to the apparatus disclosed by Thompson in the above mentioned U.S. Pat. No. 1,992,974 the apparatus according to the invention is distinguished by the following points of difference:

- co-axial cylindrical electrodes are used instead of flat plates;
- the covering is only applied to one electrode, preferably the inner one;
- the covering consists of a semi-conductive material instead of a non-conductive material.

With respect to the apparatus disclosed by Schmidt in the U.S.Pat. No. 1,650,097 the apparatus according to the invention is distinguished by the following points of difference:

- the field intensity is so low, that there is no ionization;
- the covering is continuous instead of discontinuous;
- the covering consists of a semi-conductive material instead of a non-conductive material.

DETAILED DESCRIPTION

Figures 1, 2:
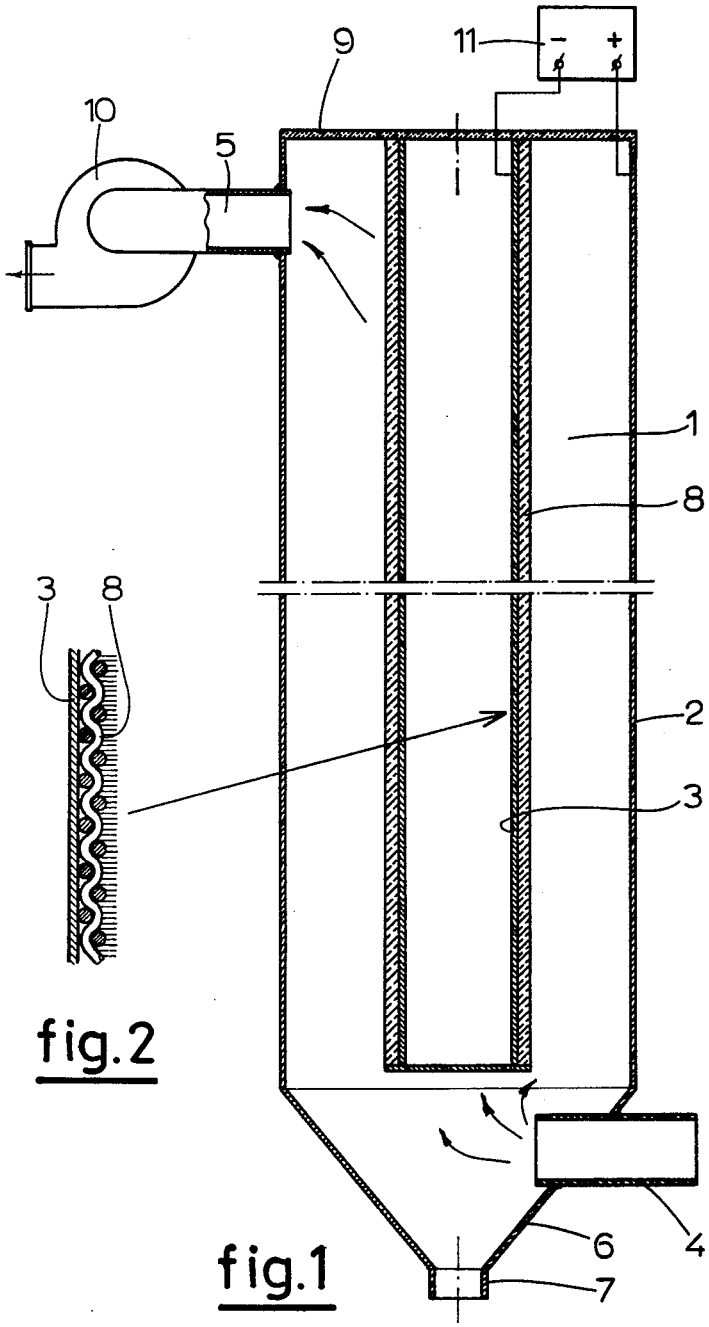
FIG. 1 shows a cross section of a preferred embodiment of the apparatus according to the invention.
FIG. 2 shows a partial cross section of the inner electrode and the covering applied thereto.

The apparatus shown in FIG. 1 comprises a separating space 1 bounded by two coaxial cylindrical electrodes, namely an outer electrode 2 and an inner electrode 3. The separating space is closed off at its top by a cover 9 made of an insulating material and also serving to insulate the electrodes 2 and 3 from each other. The electrodes 2 and 3 are respectively connected with the poles of a D.C. voltage source 11 preferably in such manner that the outer electrode 2 is connected with the positive terminal and the inner electrode 3 with the negative terminal. The use of coaxial cylindrical electrodes constitutes a simple way to obtain an electric field which is inhomogeneous in a direction perpendicular to the electrodes. In fact the surface of the inner electrode is naturally smaller than the surface of the outer electrode so that the field intensity is larger at the inner electrode. The particles in which dipole charges have been induced move in the direction towards the larger field intensity so that the particles migrate to the inner electrode 3.

The gas stream to be purified is passed in an axial direction through the separating space 1. For this purpose the gas stream is supplied to the separating space through an inlet 4 at the bottom and discharged through an outlet 5 at the top. The gas stream is induced to move from top to bottom through the separating space by an exhauster 10 at the outlet or by a compressor (not shown) at the inlet. It is also feasible to make use of the natural draft of a smoke stack for this purpose. At the bottom the separating space communicates with a funnel 6 for catching the separated particles, which is provided with an outlet opening 7 to be opened from time to time to remove the separated dust.

According to a preferred embodiment of the invention the inner electrode 3 is provided on its outer side with a covering 8 completely enclosing the electrode 3 and consisting of a hairy fibrous material, having a limited electric conductivity and a large number of outwardly projecting thin fibers. In the embodiment as shown, the covering 8 extends through the entire length of the separating space 1. Experiments have shown, however, that the same result may be obtained in many cases by means of a covering extending only through a portion of the length of the separating space, the said portion being situated on the inlet side of the gas stream i.e., at the bottom in the drawing.

During experiments, a highly increased separating efficiency was observed with materials of the above mentioned kind, namely asbestos, glass fibers with a conductive layer, metallic fibers embedded in a carrier, and textile fabrics rendered conductive by vacuum deposition. In general the efficiency increased by the use of the covering from about 80% to about 95%.

The manner in which the electrodes are supported is not shown in the drawing. Conventional means may be used for this purpose.

Extensive experiments have revealed that certain conditions must be satisfied for a successful operation,- namely:

1. the diameter of the inner electrode may not be too small because this leads to a tendency to ionize the gas stream, and may not be too large because the field is not sufficiently inhomogeneous in that case. Good results are obtained when the diameter of the inner electrode measured at the outside of the covering amounts to 20–36% of the diameter of the outer electrode.
2. In order that the particles to be removed have an opportunity to reach the inner electrode, the velocity of the gas stream may not be too large and the effective length of the separating space may not be too small. Good results are obtained with a gas velocity of at most 400 feet/min and with an effective length of at least 8 feet.
3. In order to get the required electric effect the average field intensity must be suitably chosen. Good results are obtained with an average field intensity of 14,000 – 16,500 volt/inch.
4. Since a dipole charge can only exist in a non-conductive body, the particles to be removed must be non-conductive.

We claim:

1. Apparatus for removing non-conductive particles from a gas stream, comprising a cylindrical inner electrode, a cylindrical outer electrode surrounding said inner electrode and coaxial with the same, said electrodes being insulated from each other and spaced with respect to each other so as to define a separating chamber between them, a gas inlet at one end of said separating chamber, a gas outlet at the other end of said separating chamber, means for passing the gas stream through said separating chamber from said gas inlet to said gas outlet in a substantially axial direction, means for supplying opposite D.C. voltages to the said electrodes so as to generate an electric field between them, said electric field having a relatively low intensity so that substantially no ionization occurs in the gas stream within said separating chamber and so that dipole charges are induced in the particles to be removed, and a covering layer on one of the said electrodes completely enclosing the same through at least a part of its length, said covering layer comprising a semi-conductive fibrous material and having a multitude of fibers projecting into said separating chamber.

2. Apparatus as claimed in claim 1, wherein said covering layer is provided on the inner electrode.

3. Apparatus as claimed in claim 1, wherein said covering layer is only on a portion of the length of said inner electrode, said portion lying in the vicinity of said gas inlet.

4. Apparatus as claimed in claim 1, wherein said covering layer is made of asbestos.

5. Apparatus as claimed in claim 4, wherein said covering layer comprises a ribbon woven from asbestos fibers and wound on said inner electrode.

6. Apparatus as claimed in claim 1, wherein said covering layer comprises a glass fabric of which the fibers have been rendered conductive by a surface treatment.

7. Apparatus as claimed in claim 1, wherein said covering layer comprises metallic fibers embedded in a carrier made of a synthetic insulating material.

8. Apparatus as claimed in claim 1, wherein said covering l ayer comprises a textile fabric with fibers having a conductive layer.

9. Apparatus as claimed in claim 1, wherein the diameter of the inner electrode measured at the outside of the covering amounts to 20–36% of the diameter of the outer electrode, said means for passing the gas stream passes the gas stream through the separating chamber at a velocity less than 400 feet/min, the separating chamber having an effective axial length of at least 8 feet, said voltage means provides an average field intensity of 14,000–16,500 volt/inch in the separating chamber.

10. A method of removing non-conductive particles from a gas comprising the steps of passing a stream of the gas through a separating chamber defined between two coaxial cylindrical electrodes and generating a D.C. electric field between the said electrodes having such an intensity that substantially no ionization occurs in the gas stream within said separating chamber whereby dipole charges are induced in the particles to be removed, the inner electrode being provided with a covering layer through at least a part of its length consisting of a semi-conductive fibrous material with a multitude of fibers projecting into said separating chamber.

* * * * *